US005507265A

United States Patent [19]

Ichikawa et al.

[11] Patent Number: 5,507,265

[45] Date of Patent: Apr. 16, 1996

[54] COMPENSATION METHOD AND APPARATUS FOR FUEL INJECTION AMOUNT DURING ENGINE WARM-UP

[75] Inventors: Yasuhisa Ichikawa, Nisshin; Hidehiko Asama, Toyota, both of Japan

[73] Assignee: Nippondenso Co., Ltd., Kariya, Japan

[21] Appl. No.: 459,779

[22] Filed: Jun. 2, 1995

[30] Foreign Application Priority Data

Jun. 16, 1994 [JP] Japan ..... 6-134243

[51] Int. Cl.[6] ..... F02D 41/06

[52] U.S. Cl. ..... 123/491; 123/478

[58] Field of Search ..... 123/478, 491, 123/179.16

[56] References Cited

U.S. PATENT DOCUMENTS

| | | | |
|---|---|---|---|
| 4,436,073 | 3/1984 | Miyagi | 123/491 |
| 4,653,452 | 3/1987 | Sawada et al. | 123/491 |
| 4,765,301 | 8/1988 | Koike et al. | 123/491 |
| 4,770,148 | 9/1988 | Hibino et al. | 123/491 |
| 5,163,408 | 11/1992 | Nemoto | 123/491 |
| 5,205,255 | 4/1993 | Yamagata et al | 123/491 |
| 5,233,965 | 8/1993 | Kawa et al | 123/491 |
| 5,289,809 | 3/1994 | Kamiya et al. | 123/491 |
| 5,415,145 | 5/1995 | Letcher et al. | 123/491 |

FOREIGN PATENT DOCUMENTS

| | | |
|---|---|---|
| 58-144637 | 8/1983 | Japan . |
| 3-61644 | 3/1991 | Japan . |
| 3281959 | 12/1991 | Japan . |
| 5141291 | 6/1993 | Japan . |

*Primary Examiner*—Tony M. Argenbright
*Attorney, Agent, or Firm*—Cushman, Darby & Cushman

[57] ABSTRACT

In a method and apparatus which compensates a fuel injection amount by a first fuel enrichment coefficient dependent on an engine coolant temperature during engine warm-up period after engine starting, the fuel injection amount is compensated further by a second fuel enrichment coefficient from a time an engine revolution speed falls until a time a predetermined interval lapses. The second fuel enrichment coefficient may be changed by a throttle valve opening condition and/or an engine intake air pressure. The fuel injection amount may be further compensated further by a third fuel enrichment coefficient until a time another predetermined interval shorter than the predetermined interval lapses, when a fall of the engine revolution speed is large.

10 Claims, 4 Drawing Sheets

COMPENSATION METHOD AND APPARATUS FOR FUEL INJECTION AMOUNT DURING ENGINE WARM-UP

BACKGROUND OF THE INVENTION

1. Field of the Invention

This invention relates to a compensation method and apparatus for a fuel injection amount during engine warm-up of automobiles and the like equipped with electronically-controlled fuel injection devices.

2. Description of Related Art

As one of methods for dealing with unstable combustion using fuel rich mixtures after engine start, the after-start fuel enrichment in the fuel injection quantity amount after engine start is set to be AS1 and AS2, and those AS1 and AS2 are attenuated as time lapses thereafter as shown in FIG. 3D. It must be noted here that AS1 attenuates at high speed. On the other hand, AS2 attenuates at low speed. In addition, there is also a warm-up fuel enrichment compensation WL which is adjusted according to the temperature of the engine coolant as shown in FIG. 3E.

However, these amounts of compensations are set for standard fuels and therefore, in the cases when fuels with different volatilities are used, it may occur that the amount of fuel injection is not properly adjusted to the engine conditions.

For example, crude fuels with higher vaporization points than the standard fuel have bad vaporabilities, and their use, as shown by the solid line in FIG. 3B, results in an overlean condition in air-fuel ratio (A/F) as compared with the standard fuel shown by the dot-and-dash line. Because of this, in spite of the increase in the enrichment amounts of injection after engine start and during engine warm-up, sufficient combustion is not achieved and engine revolution speed NE drops as shown in FIG. 3A, resulting in engine stalls, rough idle and backfire during acceleration. Even with crude fuels, however, if the temperature in the engine combustion chamber and the area surrounding intake valves has increased enough, the fuel's vaporability improves and as a result, engine revolution speed stabilizes and backfire during acceleration does not occur any more.

To deal with the above problem that occurs during the engine warm-up, as disclosed in Japanese Patent Laid-open Publication No. 3-61644, it is proposed that, in the case when the actual revolution speed has fallen excessively below the intended speed, the amount of the fuel injection is increased through fuel enrichment compensation coefficients which correspond with the engine coolant temperature and engine revolution speed.

However, in the above method, the fuel injection amount is increased if the engine revolution speed falls below the intended speed, and such fuel increase ceases when the engine revolution speeds up and reaches the target speed. Thus the air-fuel ratio, which used to be proper, becomes too lean, causing the engine revolution speed to fall and rough idle to occur. Furthermore, because the amount of enrichment is adjusted based on the engine revolution speed as opposed to that, in general, the amount of fuel requirements of engines differ from idle to non-idle conditions, an overlean mixture condition can occur temporarily during acceleration causing poor drivability and backfires.

SUMMARY OF THE INVENTION

It is therefore an object of the present invention to increase the fuel injection amount to an optimal level in accordance with the fuel characteristics.

For this purpose, this invention provides a compensation method and apparatus for the amount of fuel injection during engine warm-up, wherein a warm-up fuel enrichment amount of fuel injection is increased in the case when the engine revolution speed falls below a predetermined revolution speed $\gamma 1$ within a first designated period of time $\beta 2$ after the engine has started, while adjusting such enrichment amount depending on the engine load, and such increase in the enrichment amount is continued until a second designated period of time $\gamma 2$ has lapsed after engine start.

DETAILED DESCRIPTION OF THE EMBODIMENTS

The present invention will be described in detail with reference to presently preferred various embodiments illustrated in the accompanying drawings.

Figure 1:
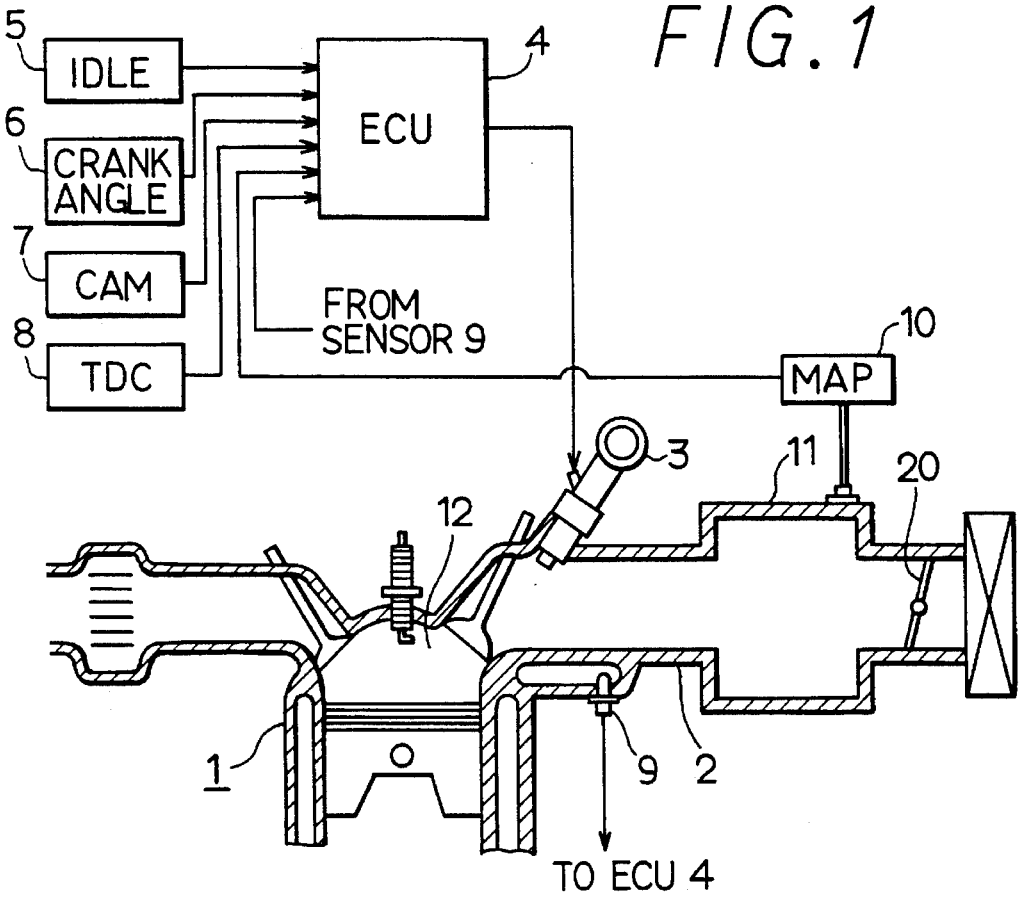
FIG. 1 is a schematic view of an embodiment of the present invention.

An engine 1, schematically illustrated in FIG. 1, is one that is mounted on automobiles and is equipped with an electronically-controlled fuel injection device. The fuel injection device has a fuel injection valve 3, which is installed on an intake pipe 2 of the engine 1 and an electronic control unit (ECU) 4 which controls the operation of such fuel injection valve 3. This electronically-controlled fuel injection device controls the amount of fuel which fuel injection valve 3 supplies into a combustion chamber 12 of the engine 1 by means of the electronic control unit 4, using information from the various sensors connected thereto. The fuel injection valve 3 has a built-in magnetic coil and, if a fuel injection signal from the electronic control unit 4 is applied to this coil, an amount of fuel proportional to the applied time of the signal is injected into an intake port of the engine 1.

The electronic control unit 4 receives, at least, the following input signals: an idle ON or OFF signal from an idle switch 5 (ON is for idle, OFF is for non-idle); an engine revolution signal from a crank angular sensor 6; a cam position signal from a cam sensor 7; a standard cylinder position signal from a TDC (top dead center) sensor 8; a temperature signal from a temperature sensor 9, which monitors an engine coolant temperature; and an intake pressure signal from a pressure sensor 10, which monitors a manifold absolute pressure in the intake pipe 2. The output of the electronic control unit 4 produces the fuel injection signal to the fuel injection valve 3. The pressure sensor 10 is constructed in such a way that it emits an electric signal according to the manifold absolute pressure of the engine and is attached to a surge tank 11 in the intake pipe 2. The temperature sensor 9, which comprises a built-in thermistor, outputs an electric signal according to the engine coolant temperature. The idle switch 5 operates according to the opening degree of a throttle valve 20 and emits an electric signal that corresponds to idle ON (closed throttle condition) or OFF (open throttle condition). Furthermore, the electronic control unit 4 computes an intake air quantity from the engine revolution signal, the intake air pressure signal and the like and computes a basic fuel injection amount TP based on the computed intake air quantity; and after engine start, compensates or corrects the basic injection amount by after-start enrichment coefficients AS1 and AS2 for increasing the fuel amount after the engine start and a warm-up enrichment coefficient WL for increasing the amount during warm-up.

Figure 2:
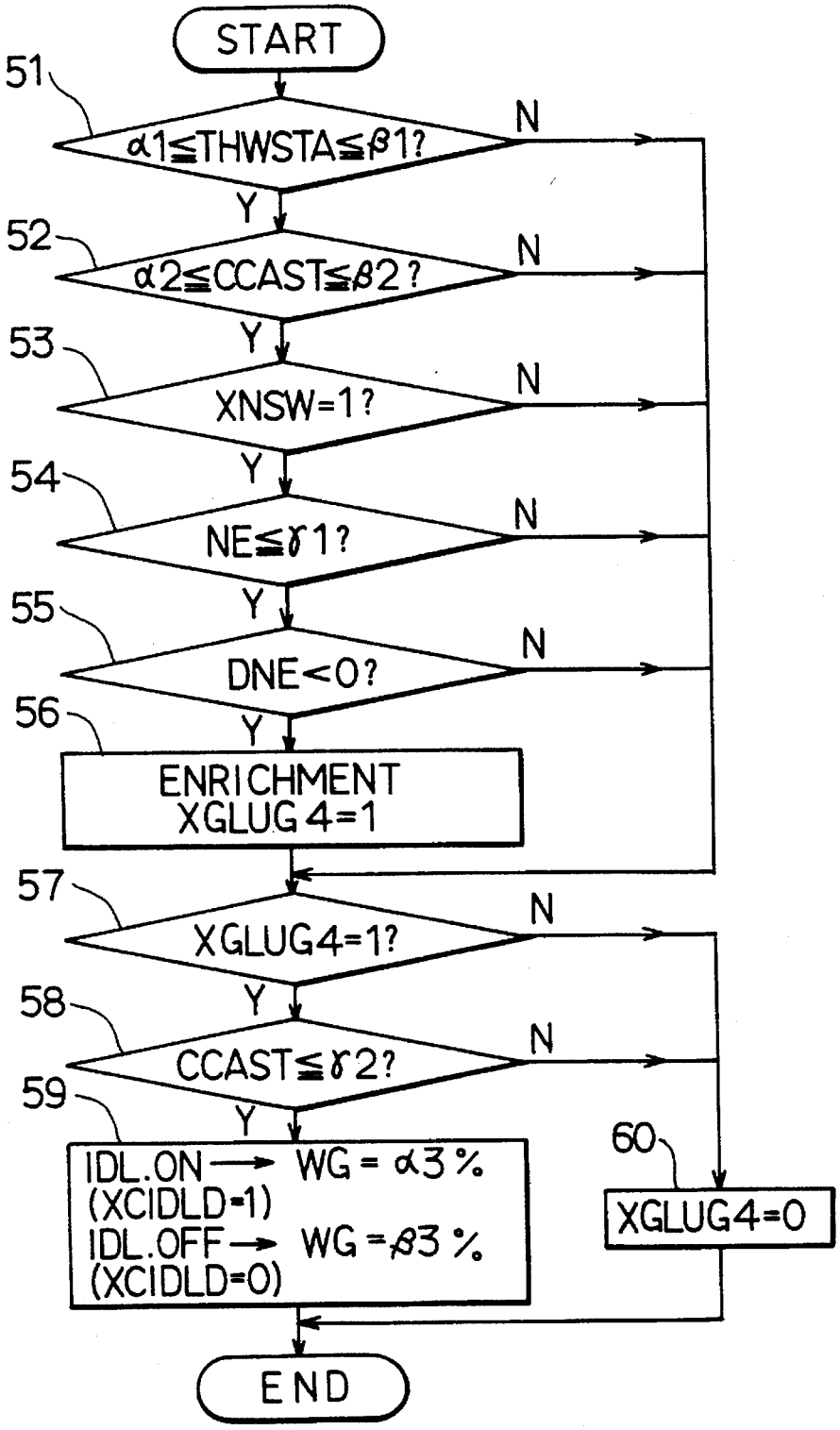
FIG. 2 is a flow chart that shows a control process of the embodiment.
Figure 3A:
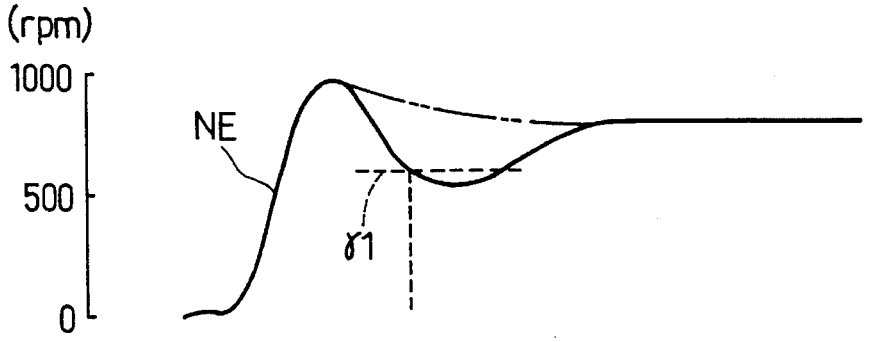
FIG.3A PRIOR ART
FIGS. 3A through 3E are waveform charts used to explain operation of the embodiment.
Figure 3B:
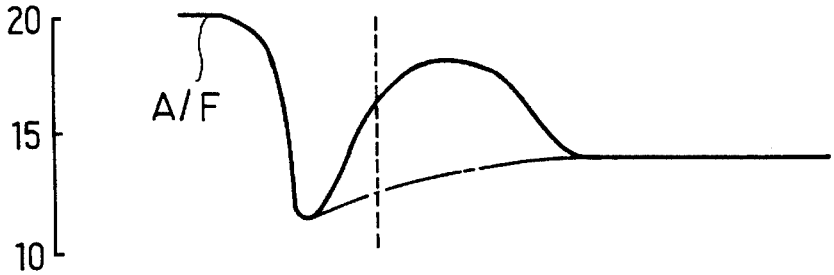
FIG.3B PRIOR ART
Figure 3C:
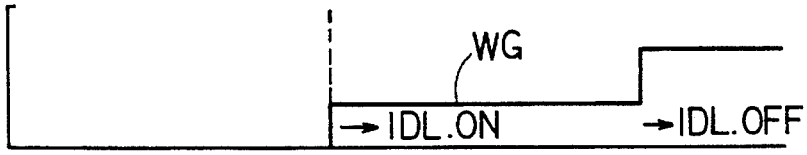
Figure 3D:
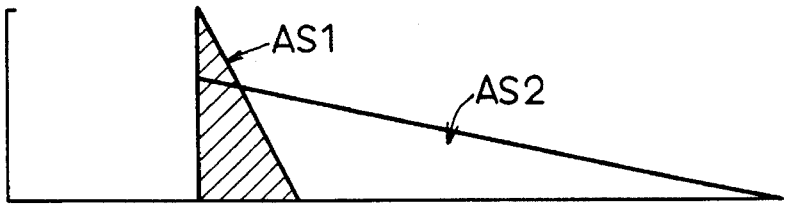
FIG.3D PRIOR ART
Figure 3E:
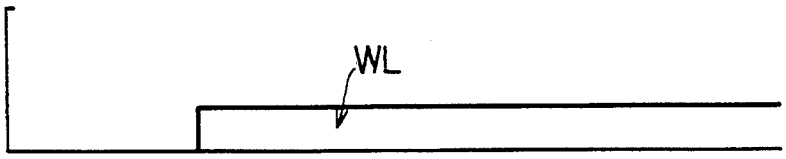
FIG.3E PRIOR ART

Here, the after-start enrichment coefficient AS1 for increasing the injection amount after engine start, as shown in FIG. 3D, has an initial value that is set according to the temperature of the coolant and is attenuated at every preset time interval at high speed until it becomes zero. The other after-start enrichment coefficient AS2 for increasing the injection amount after engine start, as shown in FIG. 3D, is set to attenuate to zero more slowly than AS1. Meanwhile, the warm-up enrichment coefficient WL for increasing the amount during warm-up has a value that is set according to the coolant temperature (the coefficient WL is increased as the temperature is low) as shown in FIG. 3E and becomes zero when the engine has warmed up (has reached a temperature of 80° C. or more). Also, a program, outlined in FIG. 2, is set to run in the electronic control unit 4 at preset time intervals. The electronic control unit 4 includes, as known well in the art, a CPU, RAM, ROM and other associated circuits and stores the control program and various preset data in the ROM. In this program, first, at a step 51, based on the temperature signal from the temperature sensor 9, the temperature THWSTA at the time of the engine start is checked on whether or not it lies between a predetermined range ($\alpha 1$=−12° C. through $\beta 1$=30° C.). If it does, then the process moves to a step 52 and if it doesn't, it proceeds to a step 57.

In a step 52, the time lapse CCAST after engine start is determined on whether or not it lies between a predetermined range ($\alpha 2$=1 sec. through $\beta 2$=5 sec.) and if it does, then a step 53 is executed and if it doesn't, it proceeds to the step 57. In the step 53, a gear shift state or position of an automatic transmission is determined: if it is the N (Neutral) range (XNSW=1) that includes the P (Parking) range, then it proceeds to a step 54 and if it is the D range (XNSW=0) that includes the L2 (Second), 3 (Third), R (Reverse) ranges, then on to the step 57.

In the step 54, the engine revolution speed NE is determined if it is below the predetermined revolution speed (e.g.,$\gamma 1$=900 rpm); if it is, then on to a step 55. Otherwise, it proceeds to step 57. In a step 55, the change DNE in the engine revolution speed NE for every predetermined period of time is determined if it is negative or not (to check if the engine revolution speed NE is increasing or decreasing). If DNE is negative (engine revolution speed NE is decreasing), then it proceeds to a step 56. Otherwise, if DNE is positive (engine revolution speed NE is increasing), then on to the step 57.

In a step 56, the flag XGLUG4 for enforcing the increase in the warm-up enrichment coefficient WL for the engine warm-up is set to 1, then next is the step 57. In the step 57, the flag XGLUG4 for enforcing the increase is checked if its value is 1 or not. If it is determined to be 1, then it proceeds to a step 58. Otherwise, it proceeds to a step 60.

In the step 58, the lapse time CCAST after engine start CCAST is checked if it is below the second predetermined period of time (e.g.,$\gamma 2$=3 minutes). If it is, then on to a step 59. Otherwise, it proceeds to the step 60. In the step 59, if the idle is ON (closed throttle condition), the warm-up fuel enrichment coefficient WG for increasing the fuel injection amount for engine warm-up is set to a value $\alpha 3\%$ (e.g.,5%) and, if the idle is OFF (open throttle condition), to a value $\beta 3\%$ (e.g.,8%) larger than than that in the case idle is ON. These values shall be used in a final fuel injection amount TAU. This coefficient WG is shown in FIG. 3C. In more detail, the relationship of the final fuel injection amount TAU is computed by the following equation, with the enrichment compensation coefficients AS1, AS2, WL and WG; the other compensation coefficient K and invalid injection time N, both of which are determined in accordance with the engine conditions.

$$TAU=TP\times(1+AS1+AS2+WL+WG)\times K+N$$

With the above control method, the fuel injection valve 3 mentioned above receives the injection signal to open for a period of time that corresponds to the final fuel injection amount TAU and thus, fuel is supplied to the combustion chamber 12. In this system, if a fuel with a high vaporization point (in other words, a fuel with inferior vaporization characteristics) is used, the air-fuel mixture becomes overlean immediately after starting as shown in the solid line in FIG. 3B, causing the revolution speed NE to drop as shown in FIG. 3A. If it drops below the predetermined revolution speed $\gamma 1$, then by the fact that the basic injection amount TP is compensated by the warm-up coefficient WG for engine warm-up, the coefficients AS1 and AS2 after engine start, and the like, the final fuel injection amount TAU itself is compensated more. Thus, the air-fuel ratio of the air-fuel mixture approaches an appropriate value, the decrease in the engine revolution stops and engine revolution speeds up to a proper level and stabilizes.

However, while the engine revolution speed has thus stabilized, if the increase in the compensation of the fuel injection amount is stopped, the air-fuel ratio of the mixture changes from the proper value to a lean one, resulting in a drop in the engine revolution speed again and causing rough idles. Furthermore, if the opening of the throttle valve 20 becomes larger (stepping on the accelerator pedal for acceleration) under the idle condition, in other words, during the transient period, if fuels with poor volatilities are used, the air-fuel ratio becomes much more leaner than in the idle ON state. To prevent this, the warm-up enrichment coefficient WG for increasing the amount of compensation during engine warm-up is continued and increased during idle OFF condition as shown in FIG. 3C. Because of such operation, troubles such as backfire caused by overlean mixture during the transient periods can be avoided. Then, after the predetermined period of time $\gamma 2$ has lapsed after engine start-up, in other words, if the coolant temperature has risen enough, the vaporability of fuels with high vaporization points improves and thus there is no longer a need to especially compensate the fuel injection amount TAU. For the case of using standard fuels, faltering revolution speed after engine start, which is caused by overlean when using fuels with high vaporization points, doesn't occur and thus, no special compensation is performed.

Figure 4:
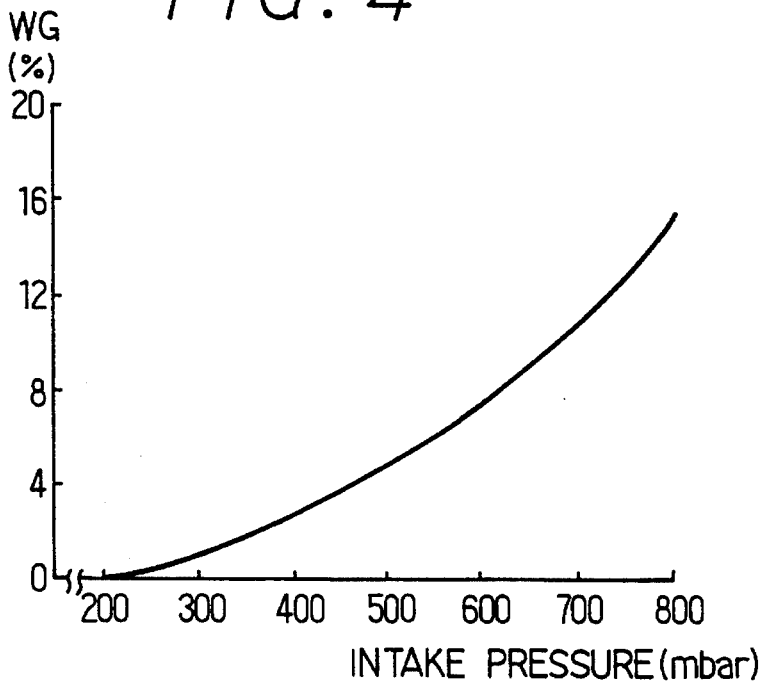
FIG. 4 is a characteristics chart of the coefficient for engine warm-up fuel enrichment in another embodiment of the invention.
Figure 5:
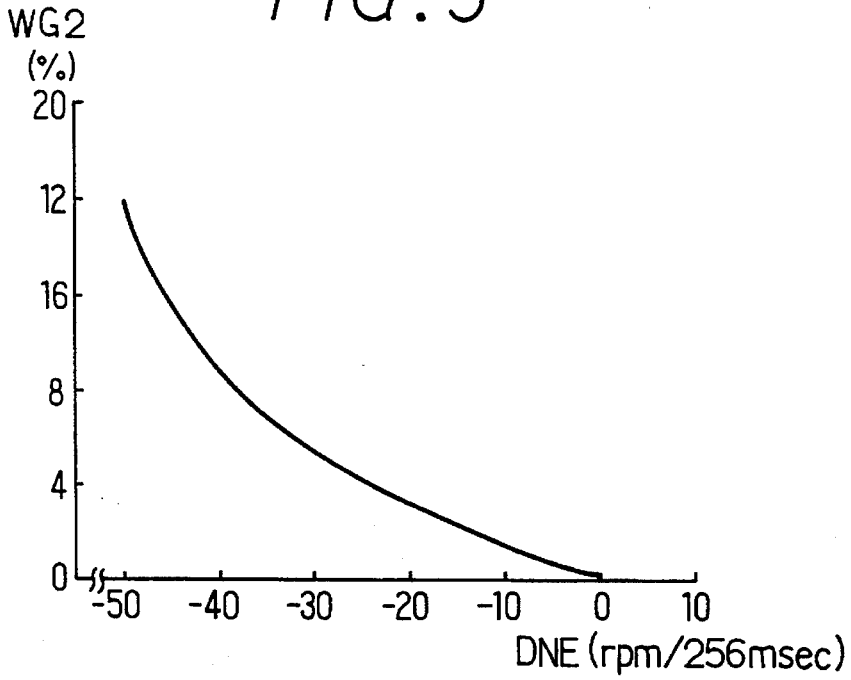
FIG. 5 is a characteristics chart of the coefficient for engine warm-up enrichment in a further embodiment of the invention.
Figure 6:
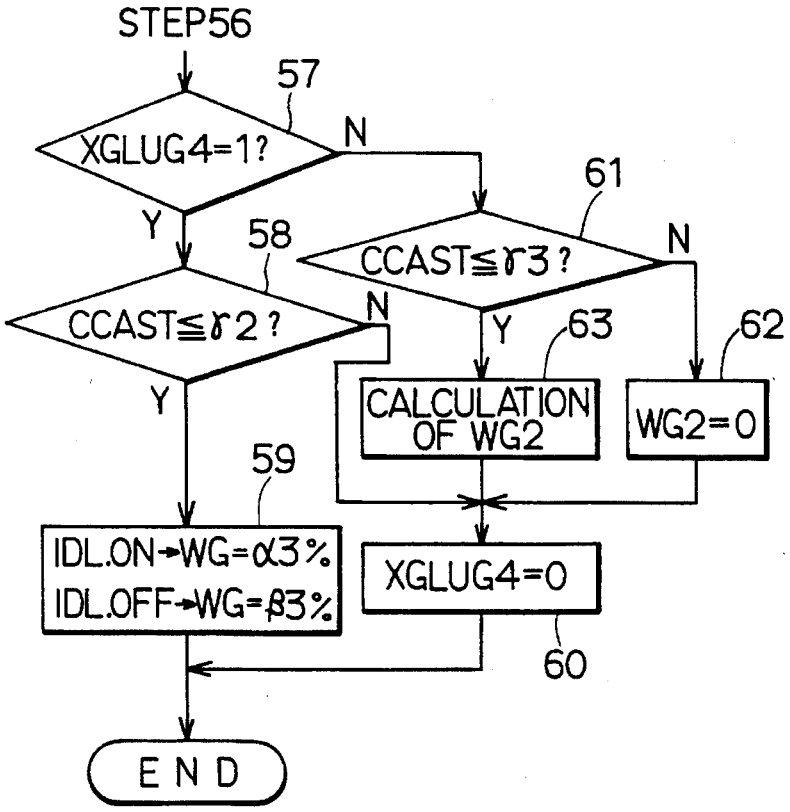
FIG. 6 is a flow chart that shows a part of control process of the further embodiment of the invention using the coefficient shown in FIG. 5.

In the embodiment described above, the value of WG was altered in the step 59 in FIG. 2 by setting the engine load condition to either idle ON or OFF. Instead, as shown in FIG. 4, the value of WG may be changed according to the intake pipe pressure, which is the engine load itself so that as the engine load is higher (higher intake pressure), WG can be set to a larger value. Also, as shown in FIG. 6, after the step 57, wherein XGLUG4 is checked if it is 1 or not, steps 61 through 63 may be added. If the lapse time CCAST after the engine start falls within the third predetermined period γ3 (γ3 is longer than the first predetermined period β2 but shorter than the second predetermined period y2 which is for example 30 seconds.), then, as shown in FIG. 5, an engine warm-up compensation coefficient WG2, which changes in accordance with the engine revolution speed change DNE, is calculated. Here, it must be noted that DNE is the amount of change per unit time of the engine revolution speed NE. If the change in the value of DNE is negative, i.e., the engine revolution speed is slowing down, the amount of compensation for engine warm-up is increased. With this new coefficient WG2, the fuel injection amount TAU is calculated as below.

$$TAU=TP\times(1+AS1+AS2+WL+WG+WG2)\times K+N$$

For the steps 52, 58, 61 in FIGS. 2 and 6, decisions were made using the lapse time CCAST after the engine start. However, decisions can also be made using the number of engine revolutions (numbers of the crank angle signal).

As stated above, according to this invention, if the engine revolution speed falls below the predetermined speed γ1 within the first predetermined period β2 after engine start, the amount of fuel injection is increasingly compensated. Engine revolution speed does not fall after engine start with the use of standard fuels, because the coefficients for compensation after engine start and engine warm-up are set to appropriate values in view of tolerances. On the other hand, only in the case of fuels with high vaporization points, the fuel enrichment coefficients for compensation are changed in accordance with the fuel characteristics to counter the fall in the engine speed.

Furthermore, because the amount of fuel enrichment is changed in accordance with the load conditions (in the embodiment, the amount of enrichment is determined by idle ON or OFF), in consideration of the fact that engine requirements differ for the different load conditions and that this holds true much so for cases when fuels with high vaporization points are used, rough idles and backfires caused by overlean mixture during transient periods and the like can be avoided.

Moreover, because the process of increasing the fuel injection amount is continued up to the second predetermined period γ2 after engine start, i.e., up to a high engine coolant temperature, then the vaporization characteristics of even those fuels with high vaporization points improve, making special additional compensation unnecessary. Also, even if the engine revolution speed picks up and stabilizes to a proper level due to the enrichment in the injection amount for warm-up, the enrichment in the fuel injection amount for warm-up is continued until the second predetermined period γ2 after engine start. As a result, fall of engine revolution speed and rough idles, both caused by the stop in the increase in the warm-up fuel enrichment, can be avoided.

The present invention having been described may be modified in many other ways without departing from the spirit of the invention.

What is claimed is:

1. A compensation method for a fuel injection amount during engine warm-up comprising the steps of:

increasing an engine warm-up fuel enrichment amount of fuel injection in the case when an engine revolution speed falls below a predetermined revolution speed γ1 within a first predetermined period of time β2 after an engine has started, while adjusting the enrichment amount in accordance with an engine load; and continuing the increase in the enrichment amount until a second predetermined period of time γ2 lapses after an engine start.

2. A compensation method as claimed in claim 1, wherein:

the amount of increase for engine warm-up is varied according to an extent of drop in the engine revolution speed after the engine start.

3. A compensation method as claimed in claim 1, wherein:

the amount of increase for engine warm-up is increased with increasing engine load.

4. A compensation method as claimed in claim 1, wherein:

the engine load is determined depending on engine idle and non-idle conditions.

5. A compensation method as claimed in claim 1, wherein:

the second predetermined period of time γ2 is set to be longer than the first predetermined period β2.

6. An apparatus for compensating an amount of fuel injected into an engine, said apparatus comprising:

sensor means for sensing engine conditions including an engine intake air, an engine revolution speed and an engine coolant temperature;

computer means for computing a fuel injection amount in accordance with said engine conditions, said computer means computing a basic fuel injection amount in accordance with said engine intake air and correcting said basic fuel injection amount by a first warm-up fuel enrichment coefficient dependent on said engine coolant temperature during an engine warm-up period, and said computer means correcting further said basic fuel injection amount by a second warm-up fuel enrichment coefficient from a time said engine revolution speed falls below a predetermined speed after an engine starting to a time a first pretermined interval lapses after said engine starting during said engine warm-up period; and injection means for injecting fuel into said engine in accordance with said computed and corrected fuel injection amount.

7. An apparatus as claimed in claim 6, wherein:

said sensing means senses throttle open/closed condition of a throttle valve of said engine; and said computer means changes said second fuel enrichment coefficient from a small value to a large value in response to a change from said throttle closed condition to said throttle open condition.

8. An apparatus as claimed in claim 6, wherein:

said sensing means senses an intake pressure as said intake air; and said computer means changes said second fuel enrichment coefficient in accordance with said intake pressure.

9. An apparatus as claimed in claim 6, wherein:

said computer means computes a change in said engine revolution speed and corrects further said basic fuel injection amount by a third fuel enrichment coefficient dependent on said revolution speed change.

10. An apparatus as claimed in claim 9, wherein:

said computer means further corrects said basic fuel injection amount by said third fuel enrichment coefficient until a time a second predetermined interval shorter than said first predetermined interval lapses after said engine starting.

* * * * *